United States Patent [19]

Wilson

[11] 4,211,370

[45] Jul. 8, 1980

[54] LINING FOR GRINDING MILLS

[75] Inventor: Clive J. Wilson, Scottsdale, Ariz.

[73] Assignee: Midland-Ross Corporation, Cleveland, Ohio

[21] Appl. No.: 963,379

[22] Filed: Nov. 24, 1978

[51] Int. Cl.[2] ..... B02C 17/22

[52] U.S. Cl. ..... 241/183

[58] Field of Search ..... 241/181, 182, 183, 284

[56] References Cited

U.S. PATENT DOCUMENTS

| | | | |
|---|---|---|---|
| 1,309,212 | 7/1919 | Marcy | 241/181 X |
| 2,801,804 | 8/1957 | Frankert | 241/183 |
| 3,042,323 | 7/1962 | Hall | 241/183 |

FOREIGN PATENT DOCUMENTS

| | | | |
|---|---|---|---|
| 535761 | 1/1957 | Canada | 241/183 |

*Primary Examiner*—Howard N. Goldberg
*Attorney, Agent, or Firm*—H. Duane Switzer

[57] ABSTRACT

A lining for grinding mills is formed by generally rectangular plates having integral raised lifter bars extending across diagonally opposite corners, and bolt receiving holes extend through the plates and lifter bars for securing the plates within a grinding mill. A lining formed by the plates has spiral ribs formed by cooperating lifter bars on diagonally adjacent liner plates.

4 Claims, 12 Drawing Figures

LINING FOR GRINDING MILLS

BACKGROUND OF THE INVENTION

This application relates to the art of grinding mills and, more particularly, to linings for such mills.

Grinding mills for grinding ore and the like commonly include a generally cylindrical shell lined with plates, and having infeed and discharge openings at opposite ends thereof. The shell is commonly inclined downwardly from the infeed and toward the discharge end for flow of ground material through the mill. In order to improve the grinding action of such mills, it is common to provide lifting bars or projections on the liner plates for lifting material up the side of the mill as it rotates. The material then falls downwardly through a greater distance to enhance grinding and general breaking up of the material within the mill. In addition, it is common to provide internal ribs or the like on the mill lining for increasing the residence time of the material within the mill. That is, internal ribs within the mill are arranged to inhibit flow of material in a direction from the infeed end toward the discharge end so the material spends a greater time within the mill before it is discharged.

Previous arrangements of lifter bars and ribs for lifting the material within the mill and delaying its progress through the mill have been relatively complicated, and expensive to manufacture and assemble.

SUMMARY OF THE INVENTION

A lining for grinding mills is formed by a plurality of generally rectangular liner plates having lifter bars extending across diagonally opposite corners. Bolt receiving holes extend through the plates and lifter bars for securing the plates within a mill. The bolt receiving holes are preferably located closer to the longitudinal centerline of the lifter bars than to the longitudinal side edges thereof.

The lifter bars extend outwardly of the plates at the diagonally opposite corners. A plurality of the plates are assembled in longitudinal and circumferential rows to form a grinding mill lining. Diagonally adjacent liner plates have the lifter bars cooperating with one another to form spiral ribs along the entire length of the lining. Diagonally adjacent plates perpendicular to the length of the lifter bars have their corners cut off to form truncated corners between which the extended portions of the lifter bars are received.

Each liner plate has a handling lug located intermediate the opposite ends of the lifter bars.

It is a principal object of the present invention to provide an improved liner plate for use in forming grinding mill linings.

It is an additional object of the invention to provide an improved lining for grinding mills.

It is also an object of the invention to provide an improved liner plate which is economical to manufacture and assemble.

DESCRIPTION OF A PREFERRED EMBODIMENT

Figure 1:
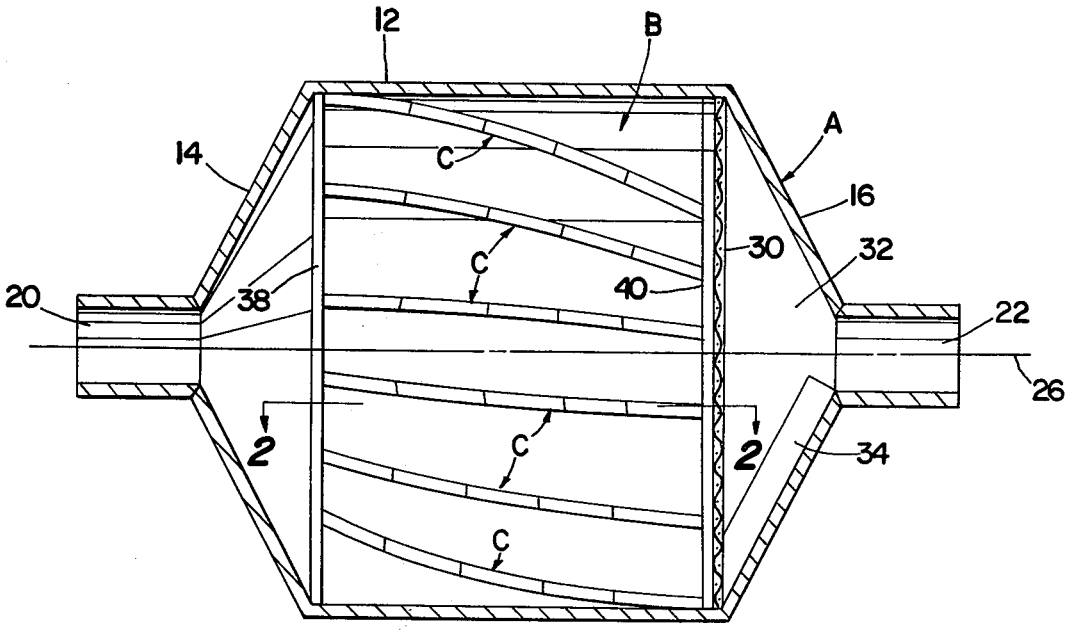
FIG. 1 is a cross-sectional elevational schematic illustration of a grinding mill.

With reference to the drawing, FIG. 1 shows a grinding mill A which includes a shell having a generally cylindrical central portion 12, and generally conical opposite end portions 14 and 16. Infeed and discharge openings 20 and 22 are respectively provided in shell end portions 14 and 16. Grinding mill A is normally positioned with its longitudinal axis 26 downwardly inclined in a direction from infeed opening 20 toward discharge opening 22 so that material will flow through the mill during rotation thereof.

Grinding mill A is lined with a lining B which also provides a plurality of inwardly extending spiral ribs C which spiral in a direction from infeed opening 20 toward discharge opening 22. Spiral ribs C lift material up the sidewalls of the mill during rotation thereof so that the material falls through a greater distance for better grinding and pulverization. In addition, the spiral ribs aid in increasing the residence time of material within the mill. For example, rotation of the mill in an opposite direction to that in which ribs C spiral will tend to cause the ribs to feed the material back toward infeed opening 20. Therefore, the material being ground will stay within the mill until it passes over and through a grate member 30 and falls into a discharge end space 32 having at least one lifting vein 34 therein which lifts material from the bottom portion of discharge space 32 during rotation of the mill A and causes same to flow through discharge opening 22. End rings 38 and 40 are provided at opposite ends of lining B at the transition between shell cylindrical portion 12 and generally conical portions 14, 16. The interior surfaces of shell end portions 14, 16 are also lined with wearplates in a known manner.

Figure 3:
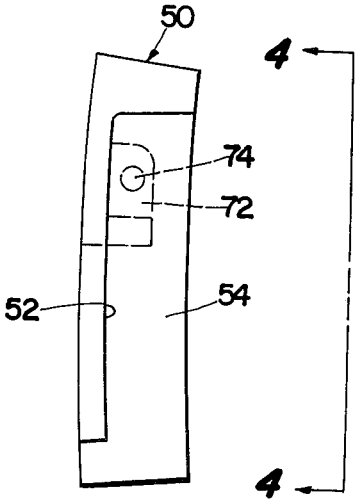
FIG. 3 is an end elevational view of a liner plate.
Figure 4:
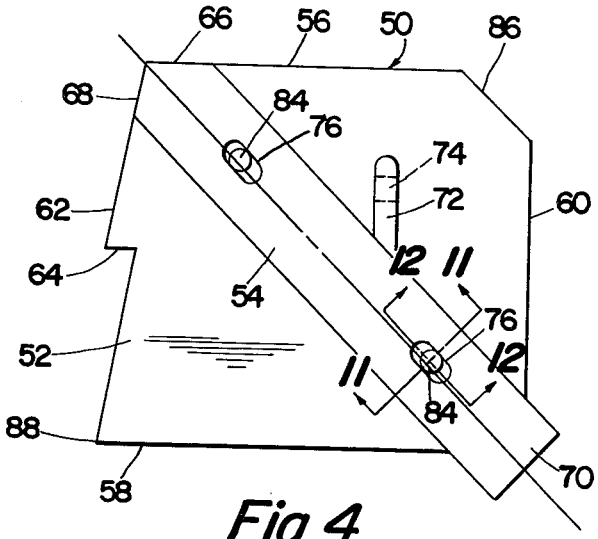
FIG. 4 is a front elevational view looking generally in the direction of arrows 4—4 of FIG. 3.

Lining B is assembled from a plurality of different one-piece cast metal liner plates of different sizes and shapes. FIGS. 3 and 4 show one generally rectangular liner plate 50 including a base 52 having an integral raised lifter bar 54 extending across diagonally opposite corners of plate 50. Plate base 52 has substantially parallel opposite edges 56, 58. The other pair of edges include a straight edge 60 extending substantially perpendicular to edges 56, 58, and a generally zig-zag edge 62 having a step 64 for cooperation with a corresponding zig-zag shape on end ring 38. At one of the diagonally opposite corners across which lifter bar 54 extends, the end portion of the lifter bar indicated at 66, 68 is substantially flush with the plate base edges 56, 62. At the other diagonally opposite corner, end portion 70 of lifter bar 54 extends outwardly beyond edges 58, 60 of plate base 52.

Lifter bar 54 has a thickness substantially greater than the thickness of plate base 52 as clearly shown in FIG. 3. Plate 50 also has an integral handling lug 72 extending outwardly therefrom intermediate the opposite ends of lifter bar 54. Handling lug 72 has a hole 74 therethrough for receiving a hook to lift and manipulate the plate.

Figure 11:
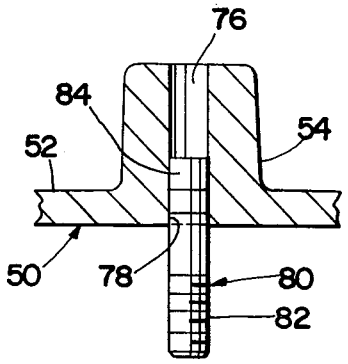
FIG. 11 is a partial cross-sectional elevational view taken generally on line 11—11 of FIG. 4.
Figure 12:
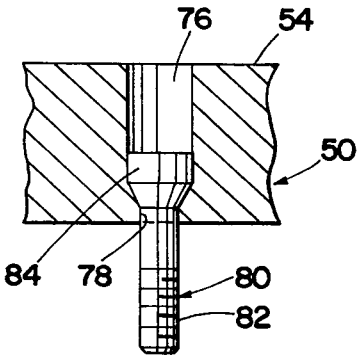
FIG. 12 is a partial cross-sectional elevational view taken generally on line 12—12 of FIG. 4.

Bolt receiving holes 76 extend through plate 50 in alignment with lifter bar 54. Bolt receiving holes 76 are preferably located as close as possible to the longitudinal centerline of lifter bar 54, and preferably closer to that longitudinal centerline than to the opposite side longitudinal edges of lifter bar 54. As best shown in FIGS. 11 and 12, bolt holes 76 are elongated in a direction parallel to the longitudinal centerline of lifter bar 54 down to a depth close to the outer surface of plate base 52. Holes 76 then taper inwardly and merge into cylindrical holes 78 which extend the rest of the way through the plate. Bolts 80 have cylindrical threaded shanks 82 extending through cylindrical holes 78 for reception through suitable holes in cylindrical shell portion 12 or a liner bed for securing the liner plates in position within the grinding mill shell. Bolts 80 include generally T-shaped heads 84 received in elongated holes 76 and this prevents rotation of bolts 80. In addition, bolt heads 84 are recessed well below the outer surface of lifter bar 54 so that wearing away of lifter bar 54 during use does not wear away the bolt head.

The other corners of plate 50 include a cut-off corner defining a generally truncated corner 86 having an edge extending substantially parallel to the opposite longitudinal side edges of lifter bar 54. The opposite corner 88 is a regular corner.

Figure 5:
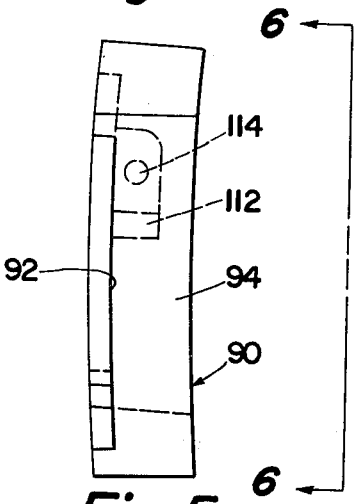
FIG. 5 is an end elevational view of another liner plate.
Figure 6:
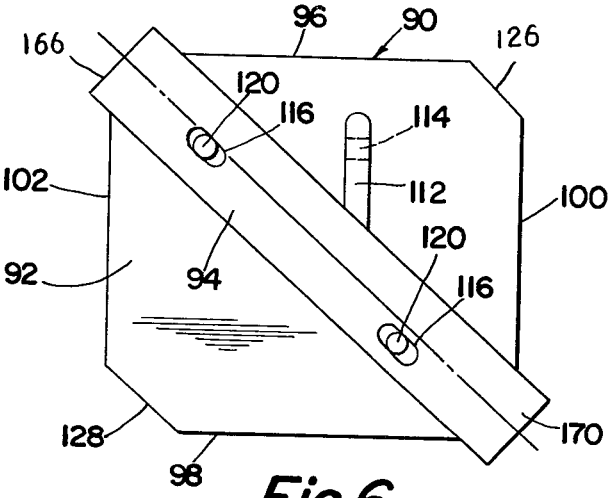
FIG. 6 is a front elevational view looking generally in the direction of arrows 6—6 of FIG. 5.

FIGS. 5 and 6 show another generally rectangular liner plate 90 having a plate base 92 and a lifter bar 94 extending across diagonally opposite corners. Base 92 has substantially parallel opposite edges 96, 98, and another pair of substantially parallel opposite edges 100, 102. The opposite end portions 166, 170 of lifter bar 94 extend outwardly beyond plate base 92 as shown in FIG. 6. A handling lug 112 is provided on plate 90 and includes a hole 114. Bolt receiving holes 116 extend through plates 90 aligned with lifter bar 94 to receive bolts 120. The other corners of plate 90 are truncated and have relatively short parallel edges 126, 128 extending parallel to longitudinal side edges of lifter bar 94.

Figure 7:
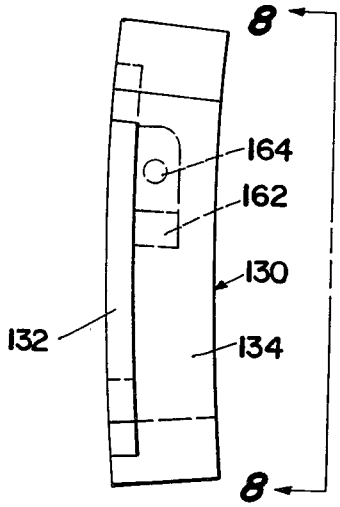
FIG. 7 is an end elevational view of another liner plate.
Figure 8:
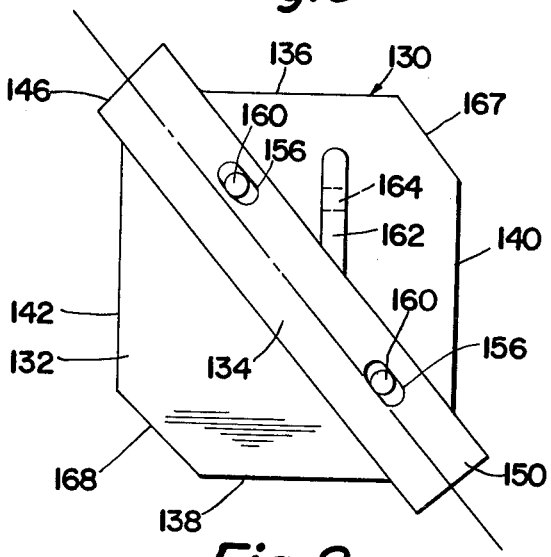
FIG. 8 is a front elevational view looking generally in the direction of arrows 8—8 of FIG. 7.

FIGS. 7 and 8 show another liner plate 130 having a lifter bar 134 extending across diagonally opposite corners. Plate 130 has substantially parallel opposite edges 136, 138, and another pair of substantially parallel edges 140, 142. The opposite end portions 146, 150 of lifter bar 134 extend outwardly beyond the periphery of plate base 132. Holes 156 are provided for receiving bolts 160. A handling lug 162 is provided intermediate the opposite ends of lifter bar 134 and a hook receiving hole 164 is provided therein. The other corners of plate base 132 are truncated to provide relatively short parallel edges 167, 168 extending parallel to the opposite longitudinal side edges of lifter bar 134.

Figure 9:
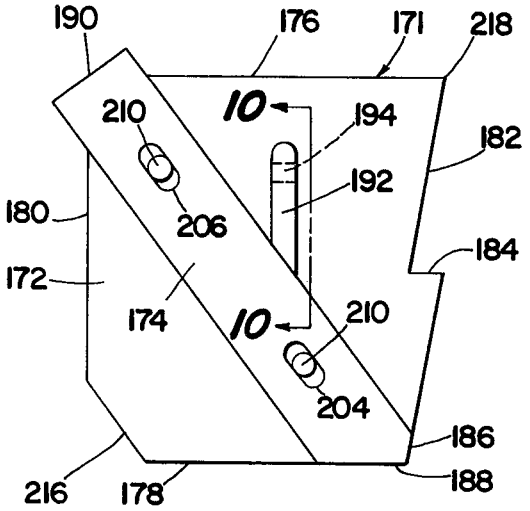
FIG. 9 is a front elevational view of still another liner plate.
Figure 10:
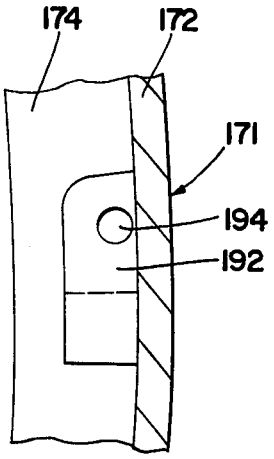
FIG. 10 is a partial cross-sectional elevational view taken generally on line 10—10 of FIG. 9.

FIGS. 9 and 10 show another liner plate 171 having a base 172 with a lifter bar 174 extending across diagonally opposite corners. Plate 171 has substantially parallel opposite edges 176, 178. The other edges of plate 171 include a straight edge 180 extending substantially perpendicular to edges 176, 178 and a zig-zag edge 182 including a step 184 for cooperation with a corresponding zig-zag shape on end ring 40. End portions 186 and 188 of lifter bar 174 are substantially flush with edges 182 and 178. The opposite end portion 190 of lifter bar 174 extends outwardly beyond the periphery of plate base portion 172. An integral handling lug 192 extends upwardly from base 172 and is integrally connected with lifter bar 174. A hook receiving hole 194 is provided in handling lug 192. Bolt receiving holes 204, 206 are provided for receiving bolts 210 in the same manner as described with respect to FIGS. 11 and 12. The other corners of plate 171 include a truncated corner 216 and a regular corner 218.

Figure 2:
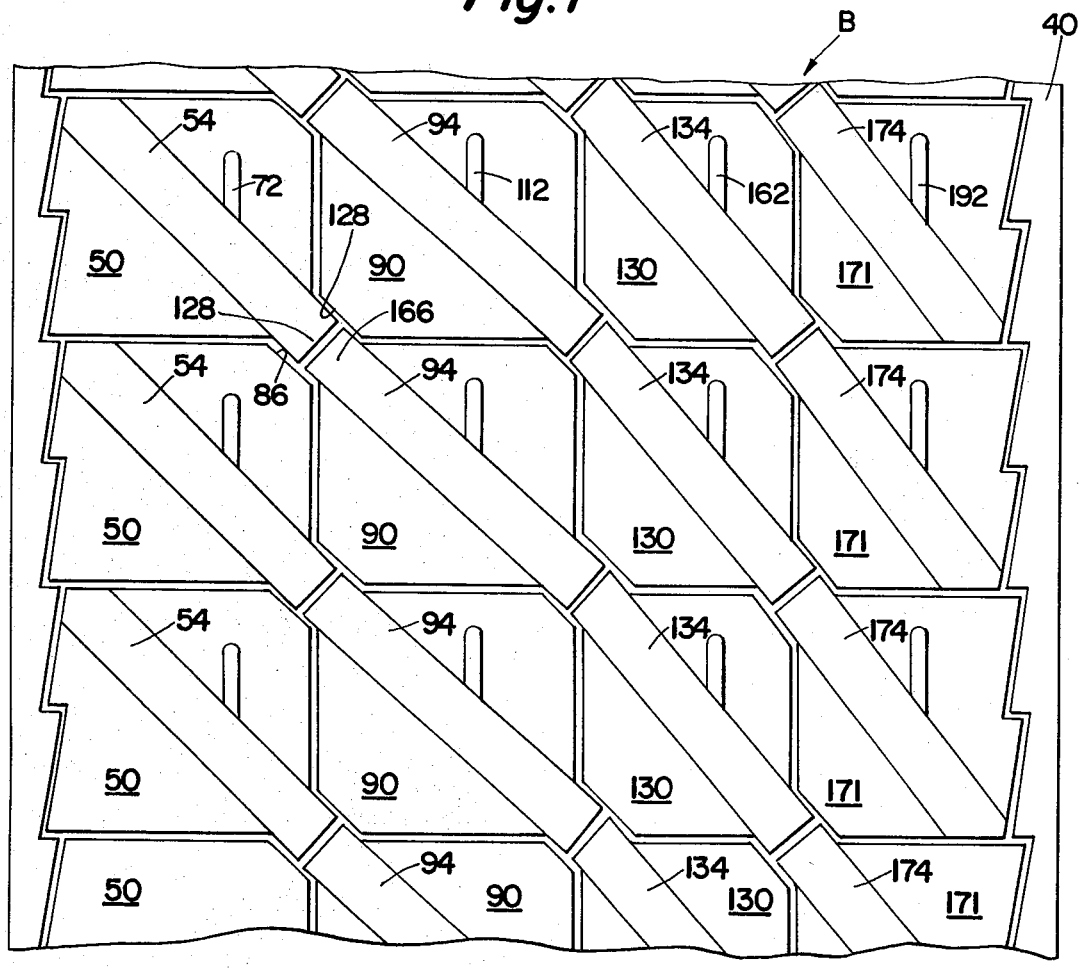
FIG. 2 is a partial cross-sectional plan view taken generally on line 2—2 of FIG. 1, and with the generally cylindrical lining unfolded to lie down upon a flat surface.

The liner plates are assembled in side-by-side relationship as shown in FIG. 2. The plates are assembled in longitudinal and circumferential rows. Each circumferential row includes a plurality of identical plates 50, or 90, or 130, or 171. Each longitudinal row of plates includes a plurality of different plates of different sizes and shapes 50, 90, 130 and 171. The plates are assembled with their lifting bars aligned with one another so that diagonally adjacent plates 50, 90, 130 and 171 have their lifter bars 54, 94, 134 and 174 aligned with one another. Each of the plates is curved as shown in FIGS. 3, 5, 7 and 9 so that the assembled plates conform to cylindrical shell portion 12. FIG. 2 is a projection so that the opposite longitudinal side edges of the lifter bars do not appear to extend along straight lines. However, in the actual mill, the cooperating lifter bars define spiral ribs C.

The truncated corners of each plate are dimensioned and proportioned for accommodating the projecting end portions of the lifter bars on other plates. For example, with reference to FIG. 2, plates 50 and 90 which are diagonally adjacent one another in a direction perpendicular to their lifter bars 54, 94, have their truncated edges 86 and 128 positioned on opposite sides of projecting lifter bar end portions 70 and 166. Thus, the length of truncated edge 86 is approximately the same as the projecting length of lifter bar end portion 70 adjacent edge 58 plus the projecting length of lifter bar end portion 166 on plate 90 adjacent edge 102. The other truncated edges are correspondingly dimensioned for positioning on opposite sides of projecting lifter bar end portions in close relationship thereto.

All of the lifter bars have a generally rectangular cross-sectional configuration, and have a width substantially less than the distance across diagonally opposite corners of a plate. Lining B is designed for increasing the residence time of material within grinding mill A. Therefore, grinding mill A rotates in a direction such that lining B in FIG. 2 moves downwardly. This causes material to flow along the lifter bars back toward the infeed opening so that the residence time is increased. Handling lugs 72, 112, 162 and 192 are located on the opposite sides of the lifter bars from which material normally strikes the lifter bars. This reduces wear of the handling lugs and also minimizes any interference of the handling lugs with optimum operation of the lining.

Although the invention has been shown and described with respect to a preferred embodiment, it is obvious that equivalent alterations and modifications will occur to others skilled in the art upon the reading and understanding of this specification. The present application includes all such equivalent alterations and modifications, and is limited only by the scope of the claims.

I claim:

1. A generally rectangular liner plate for grinding mills, said plate having an integral raised lifter bar extending across diagonally opposite corners, bolt receiving holes through said plate and lifter bar for receiving bolts to secure the plate within a grinding mill, and said lifter bar having at least one end extending outwardly beyond one of said diagonally opposite corners.

2. The liner plate of claim 1 wherein both ends of said lifter bar extend outwardly beyond said diagonally opposite corners.

3. The liner plate of claim 1 wherein the other end of said lifter bar is substantially flush with the edges of said plate at the other diagonally opposite corner.

4. A lining for a grinding mill comprising: a plurality of generally rectangular plates positioned in side-by-side relationship in circumferential and longitudinal rows and forming a generally cylindrical lining, each said plate having a lifter bar extending across diagonally opposite corners, said lifter bars on diagonally adjacent plates cooperating to define a plurality of generally spiral ribs from one end to the other of said generally cylindrical lining, at least one end of said lifter bars extending outwardly of said plate at one diagonally opposite corner, and the other corners of said plates being removed.

* * * * *